US005303783A

United States Patent [19]

Begnaud et al.

[11] Patent Number: 5,303,783

[45] Date of Patent: Apr. 19, 1994

[54] HORIZONTAL EARTH BORE TOOL

[76] Inventors: Rudy J. Begnaud, 126 Exploration Rd., Broussard, La. 70518; Bradley Begnaud, Rte. 1, Box 89, Youngsville, La. 70592

[21] Appl. No.: 24,077

[22] Filed: Mar. 1, 1993

[51] Int. Cl.[5] ..... E21B 15/04; E21B 3/00; E21B 19/00

[52] U.S. Cl. ..... 175/53; 175/62; 175/85; 175/122; 175/162; 175/203; 175/220; 254/29 R

[58] Field of Search ..... 175/53, 62, 85, 122, 175/162, 189, 220, 203; 254/29 R; 173/185

[56] References Cited

U.S. PATENT DOCUMENTS 4,043,136 8/1977 Cherrington ..... 175/53 X
4,249,620 2/1981 Schmidt ..... 175/53
4,453,603 6/1984 Voss et al. ..... 175/53
4,547,109 10/1985 Young et al. ..... 175/85 X
4,595,065 6/1986 Wada et al. ..... 175/85
4,703,811 11/1987 Lam ..... 175/85 X
4,953,638 9/1990 Dunn ..... 175/62 X

*Primary Examiner*—Hoang C. Dang
*Attorney, Agent, or Firm*—John D. Jeter

[57] ABSTRACT

The rig has a base frame, with powered ground screw anchors, trunnion attached to a tiltable top frame equipped with pipe handling rollers, pipe clamp, power tongs, and crosshead mounted swivel arranged to slide along the frame to transfer axial forces to a drill string situated parallel to and centered above the top frame. The swivel is plumbed to deliver drilling fluids to the drill string. Remote power sources provide drilling fluid processing and hydraulic power to the various controls to operate; a tilt mechanism to tilt the top frame to align with a well bore, power tongs, to move the crosshead, rotate the ground screws, a pipe stabbing roller and a pipe cradle to move pipe sections into and out of the rig working center. Operator cab stations are positioned along the top frame and are bearing mounted to stay vertical when the top frame is tilted.

20 Claims, 3 Drawing Sheets

HORIZONTAL EARTH BORE TOOL

This invention pertains to apparatus to assist in handling a drill string used for drilling and work over of horizontal earth boreholes. More particularly the apparatus, or receiving rig, is used to manipulate the end to the drill string after it breaks from the earth surface after a bore hole is drilled at a distal location under obstructions such as rivers, right of way, and the like.

BACKGROUND OF THE INVENTION

In the production of earth bore holes that extend from one side of an obstruction to the other a slant hole drilling rig is positioned on one side of the obstruction and a drill string is used to drill under the obstruction and the drill string is caused to rise to the surface on a selected site on the opposite, or outcropping, side. When the drill string emerges from the earth the loose end with a drill head attached has no further guidance from the bore and drilling action is stopped until a site is prepared for drilling fluid, cuttings, and the like and an arrangement is prepared, at the outcropping location, to change out drill heads and other attachments on the drill string. A larger drill head is usually installed to drill in the opposite direction and the drilling rig proceeds to draw the drill string back toward the drilling rig, enlarging the original bore. If no trouble evolves this process needs little improvement but trouble with horizontal holes is commonplace. Horizontal earth bores are rarely confined to well consolidated formations ideal for well bore wall stability. The bores often cave in on the drill string. Cuttings are hard to manage as the well bore size increases and they frequently cause a string to stick in the bore.

A stuck string often has to be put in compression to loosen the stuck drill head, especially in reverse drilling. Drill strings accept tension quite well but column loads in compression cause buckling, kinking at tool joints, and other problems and various contrivances have been necessary to enable the process to continue. In open country, crawler tractors have been used to pull on the bit end of the drill string either by cable or a surface-to-surface continuous drill string. Either cable or drill string has to be attached at the outcropping end before reverse drilling starts and tool joint connections usually have to be made at both ends as drilling proceeds if continuous drill string is used. Cable damages the bore wall and coordination of a crawler tractor and a drill rig axial control system is difficult at best.

Under ideal circumstances a drill string suspended between separated locations by tension alone will describe an arcuate line and no wall loads would be applied to a well bore having an identical arcuate centerline. Such circumstances rarely occur but illustrate the reduced bore wall loads in most well bores classed as horizontal when tension is applied to both ends of the practical drill string. Full length tension, in nearly all such bores, preserves bore wall conditions and reduces formation break down and string sticking.

Winches have been used to apply tension to the drill head end of the drill string but winches cannot apply compression forces upon the drill string and the destructive cable is still present. Winches are commonly used in built up areas and a disorganized work area is already an environmental burden.

There is a need for apparatus that can receive the outcropping drill string and manipulate the tension, compression and breakout and make-out of connections in a developed, well organized, manner. Additionally, the continuous drill string system invites pumping drilling fluid from both ends of the drill string to clear cuttings and to maintain the wall conditioning of the bore in both directions from a mid string drill head. Further, the time when fluid and cuttings could be randomly disposed of at either end of the drill string has come to an end.

It is therefore an object of this invention to provide manipulation apparatus for the outcrop end of a horizontal surface-to-surface earth bore that can apply either tension or compression to the drill string, provide tool joint breakout and make-up means, and drilling related fluid flow controls in a composite, highway transportable, framework.

It is another object to provide manipulation apparatus for the outcropping end of the drill string and flow controls to direct drilling fluids to the outcropping end of the drill string.

It is yet another object to provide drill string manipulation apparatus for the outcropping end of the drill string that has powered ground anchor screws to support, position, and restraint for the related framework.

It is still a further object to provide a framework for the manipulation apparatus having a powered screw anchoring arrangement on a ground contour frame with a hinge attached pipe handling frame that has power tilting means to align the pipe handling frame with the bore hole direction at the outcropping end.

These and other objects, advantages, and features of this invention will be apparent to those skilled in the art from a consideration of this specification, including the attached claims and appended drawings.

SUMMARY OF THE INVENTION

A pipe manipulation frame is hingedly supported on a base frame that is equipped with powered screw ground anchors. The base frame, with the pipe handling frame on top, conforms generally to the available ground plane until the anchors are driven into the ground. Power lifting means, a hydraulic arrangement is preferred, lifts the rear end of the manipulating frame while the front end, nearest the outcropping bore, pivots on hinges securing it to the base frame. When the manipulation frame operational centerline is generally aligned with the outcropping bore the lifting arrangement is secured. The pipe handling, or top, frame, generally rectangular in shape, provides laterally spaced tracks to carry two pairs of breakout tongs, pipe centralizing rollers, and a crosshead with a swivel to attach to the end of the outcropping drill string. The swivel is plumbed to deliver and control fluid into and out of the drill string bore. The plumbing is arranged to deliver fluid from the drill string bore to receiving tanks and to admit fluid from a pumping source to the drill string bore. A hydraulic cylinder provides either tension or compression axial force to the drill string by way of the axially movable swivel crosshead. A paired assembly of two pipe tongs, at least one powered, is situated near the bore end and is axially movable along the track by a hydraulic cylinder to align with the tool joint to be handled. About one pipe joint length farther back from the first set of tongs a second pair of similar tongs is situated, similarly powered and similarly movable axially. The second set of tongs can service the tool joint on the arbor protruding from the swivel, made possible by the track arrangement and travel ranges of tong set and swivel.

The frames are necessarily more than twice as along as two pipe string sections and are both joined in the general center of the length by demountable, preferably bolted, connections. Once connected, on the operation site, both frames are rigid.

Pipe handling equipment provides for building up a string going into the bore as well as dismantling the string by sections and storing sections of pipe being received from the bore. Pipe sections are moved to and from an optional pipe rack normally situated alongside the base frame by a cradle arrangement that moves the sections between the operational centerline of the top frame to the rack. The cradle is attached to the top frame and is hydraulically powered to lift the section from rollers in the frame center and allows it to roll laterally to the side for admission to the rack.

The tongs and swivel are necessarily distributed axially along the length of the apparatus and represent too much distance for one operator to visually control. There are three operator stations attached to the handling frame. These are cab stations with ability to tilt relative to the handling frame to keep the operator station vertical. One station is near the front end and the first set of pipe tongs. A second station is positioned about one pipe section length along the frame to allow visual access to the second set of pipe tongs. The third station is on the opposite side of the handling frame in view of the pipe racks and the swivel and fluid controls for the swivel. The swivel can move axially somewhat more than one pipe joint length and the third station is situated to provide visual control still farther away from the bore end of the frame.

Axial movement of the swivel is controlled by a hydraulic cylinder, extending along the handling frame centerline, somewhat below the operational centerline reserved for the drill string being handled. Axial forces applied to a drill string near a horizontal orientation, especially compressive forces, prohibit spinning a full length of a pipe section without lateral support in the manner of vertical drilling operations. Axially movable pipe stabilizers, two being preferred, are distributed along the track that carries the swivel. These stabilizers can be manipulated axially by connecting them to the swivel by lengths of chain that limit the distance between the stabilizers and the swivel and between the two stabilizers. The chains swing freely until pulled taut by the moving swivel.

The bore end of the handling frame is equipped to accept bore casing, when it is installed, to control effluent from the bore and direct it to receiving tanks. An initial, minimal receiving tank dominates the lower side of the base frame to prevent any fluids, bore working fluids and spillage of the various apparatus related fluids, from reaching the ground. Also at the front end of the handling frame a pipe securing clamp is situated to keep the drill string from moving axially while breakout and make-up procedures are under way. The clamp is, preferably, a hydraulically operated tapered collet situated for power controlled axial movement in a tapered bore.

BRIEF DESCRIPTION OF DRAWINGS

In the drawings wherein like features have like captions.

DETAILED DESCRIPTION OF DRAWINGS

Figure 1:
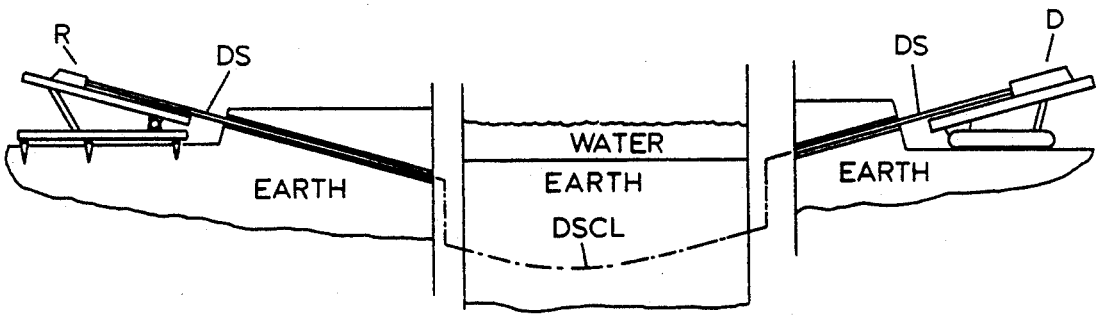
FIG. 1 is a symbolic panoramic view of a typical operational environment.

In the drawings many features pertaining to manufacturing and maintenance utility, well known in the art of machine construction and not bearing upon points of novelty, are omitted in the interest of descriptive efficiency and clarity. Such features may include threaded fasteners, weld lines, hydraulic lines, and the like. Hydraulic plumbing alone would make the drawings uselessly confusing and are omitted.

Hydraulic networks of many and varied forms are widely practiced in the art with all components utilized in the present invention commercially available. The placement of controls and lines to serve the present purpose would be largely designers choice and they are not shown.

FIG. 1 represents a bore hole operation under a river and the arcuate drill string center line DSCL is commonly referred to as a horizontal well bore. The drilling rig D, not part of this invention, may be a mile or more from the receiving unit R to which this invention is directed. Both the drilling rig and the receiving unit (rig) can pull or push the drill string and both can pump fluids into the drill string bore and receive return circulation from the bore. Both units can assemble or dismantle drill strings in joint length sections. The well bore is first drilled under the obstruction and guided, by processes in the drilling art, during the drilling operation, to outcrop at the site of the receiving unit as shown. Usually, the bore is first drilled and the site prepared for the receiving unit after the drill string crops out of the ground to allow some guidance error.

For descriptive efficiency the general functional description of the cooperating major assemblies and their relationships will proceed on small scale drawings, FIGS. 2 and 3, with more specific details reserved for larger scale drawings of the individual assemblies presented later herein.

Figure 2:
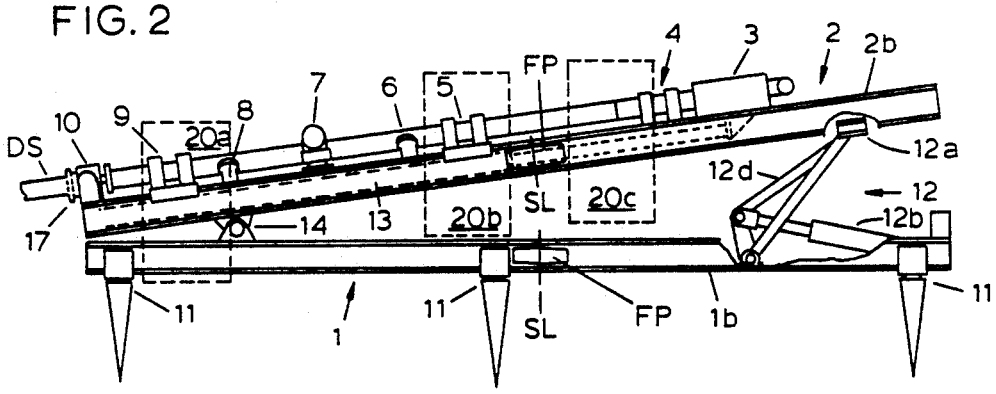
FIG. 2 is a side elevation of the receiving unit of this invention.

FIG. 2 shows the receiving unit in the usual use configuration with the top frame 2 tilted to align with the well bore, supported by the base frame 1, with a length of drill string DS in the usual position along the operational centerline. The receiving unit requires hydraulic power sources for the various powered devices to be described and pumping equipment for drilling fluids. Those units are usually composite units, trailer mounted, and remotely located some distance away. They are not part of this invention and are not shown.

The assembly shown in FIG. 2 is shipped to the site with top and base frame parallel and both separated at juncture SL. On site they are joined by bolted fish plates FP. There are six hydraulically powered ground screws 11 (FIG. 11) which rotate to anchor the base frame to the earth. With the base frame anchored, tilt mechanism 12 is actuated to tilt the top frame. Hydraulic cylinder 12*b* extends to rotate frame 12*c* to the position shown. Slippers 12*a* slide along the lower flange of the side members of the top frame as tilting progresses. The top and base frame are hingedly joined on each side by trunnions and pins 14.

Figure 3:
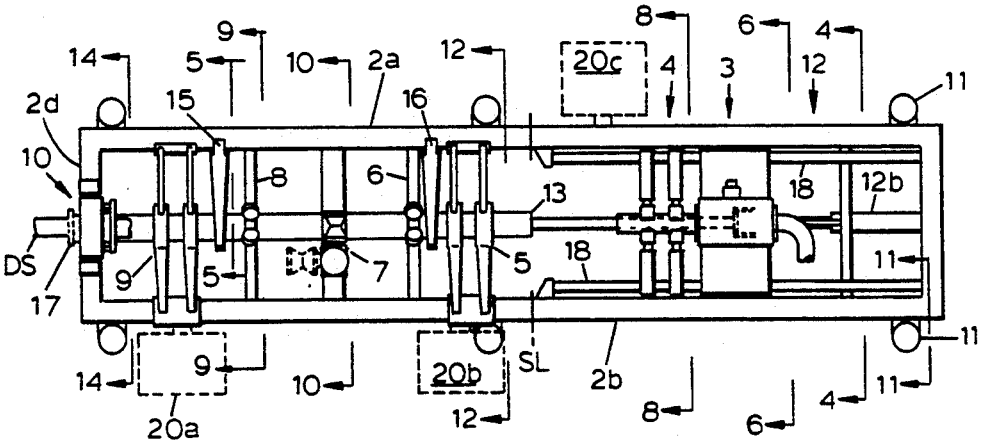
FIG. 3 is an elevation from the top of the unit shown in FIG. 2 with the top frame horizontal.

FIG. 3 is a top view of the assembly of FIG. 2 and both will be collectively described. Swivel assembly 3 is axially movable about one pipe joint distance along the top frame, carried by tracks 18 secured to the side beams 2*a* and 2*b*, forced by cylinder 13 secured to the box beam frame end 2*d*. A full joint length spins well in vertical rigs but not in horizontal rigs and follower pipe stabilizers 4 are provided, also mounted on the tracks 18 to be distributed along an unsupported length of pipe between the swivel and the first stationary stabilizer rollers. The drill string DS in FIG. 3 is cut short to show cylinder 13. Pipe roller stabilizers 6 and 8 stabilize and support the drill string. Power tong sets 5 and 9, spaced about one pipe joint length apart are axially movable a limited amount to align with tool joints axially entering the handling (top) frame but remain positioned around the pipe centerline. Powered pipe stabbing roller 7 is vertically movable and can be swung aside to clear pipe to be removed from the rig. It moves pipe axially to bring threads into and out of engagement. The drill string being assembled or dismantled is free to move axially if not clamped to the rig and powered slips 10 serve that purpose. Power slips are used to suspend drill strings in vertical drilling rigs and assembly 10 is merely adapted to operate without dependence upon drill string tension by hydraulically forcing a clamping collet into gripping or releasing positions. When pipe is to be removed between the operational centerline and pipe racks outside the frame (none shown) the pipe section is lifted to clear rollers 6 and 8, after the tong sets 5 and 9 are moved axially to clear the section to be handled. Power lifted cradle beams 15 and 16, normally lowered to clear other operations, are raised to lift the pipe section and to serve as trundle rails for pipe to be rolled laterally to and over the side beam.

Optional casing flange 17 is used to attach the rig to well surface casing, if such casing is used.

Operator cabs 20A, 20B and 20C are mounted on the top frame on mounts that permit the cabs to pivot to remain vertical when the top frame is tilted.

Figure 4:
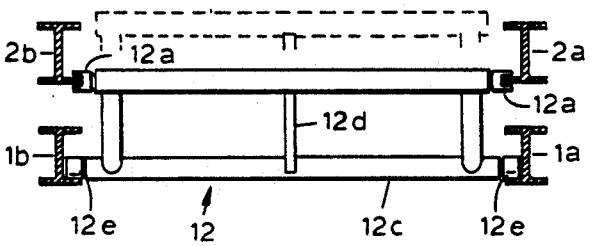
FIG. 4 is view of the top frame tilting arrangement, somewhat enlarged, viewed from line 4—4 of FIG. 3.

FIG. 4 shows the tilting mechanism 12 of FIG. 2. Top frame side beams 2*a* and 2*b* are shown in the transport, or folded, position above base frame side beams 1*a* and 1*b*. Pipe weldment tilting frame 12*c* is supported for rotation about the lower pipe centerline in trunnions 12*e* attached to beams 1*a* and 1*b*. Slippers 12*a* have cylindrical ends bearingly carried in the bore of the top pipe. The slippers are vertically secured, for longitudinal sliding, on the lower flanges of the side beams of the top frame. Cylinder 12*b*, shown in FIG. 2, has a clevis rod end pivotably pinned to weldment member 12*d* to enable extension of the cylinder to rotate the tilting frame. Extension of the cylinder raises the back end of the top frame.

Figure 5:
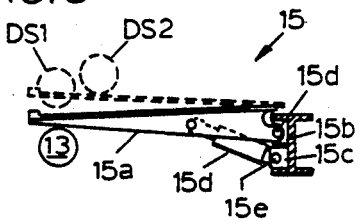
FIG. 5 is a view, somewhat enlarged, taken along line 5—5 of FIG. 3.

Description of FIG. 5 will be deferred to follow supporting descriptions.

Figure 6:
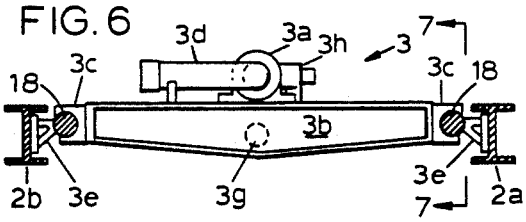
FIG. 6 is a view, somewhat enlarged, taken along line 6—6 of FIG. 3.

FIG. 6 is a view from the back of the swivel assembly 3 showing the crosshead structure and track supports. Cylindrical tracks, or rails, 18 extend some distance parallel to the side beams 2*a* and 2*b* to which they are attached by brackets 3*e*. Two cross members 3*b* have a common top plate to which swivel 3*a* is attached. Slippers 3*c*, attached to members 3*b*, carry and restrain the crosshead assembly for longitudinal movement along tracks 18. Gooseneck 3*d* is the usual drilling fluid delivery system for swivels used in drilling. Dump valve 3*h* is opened to dump fluid from the drilling fluid circuit when connections are to be broken out. Outline 3*g* shows the position of the rod of cylinder 13 secured axially to the far side of the crosshead.

Figure 7:
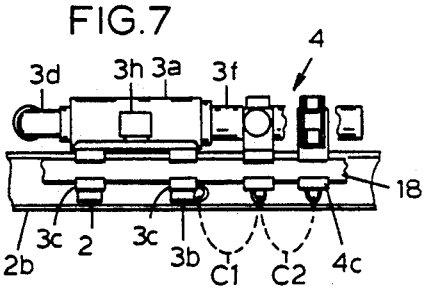
FIG. 7 is a view of the arrangement of FIG. 6 taken along line 7—7 of FIG. 6.

FIG. 7 is a view from the right side of FIG. 6 with the beam 2*a* omitted for viewing the principal crosshead structure. This also shows the follower pipe stabilizers 4 of FIG. 3 which are also carried by tracks 18 and their description will be in conjunction with FIG. 8. Tubular member 3*f* is the swivel arbor to be attached to drill string. It usually consists, in part, of a thread saver sub. Flexible lines, or chains, C1, and C2 will distribute followers 4 along track 18 when the crosshead moves leftward toward the back of the top frame. When the crosshead moves rightward, the swivel structure bumps the followers along, slackening the chains, and keeping the followers transverse to the operational centerline.

Figure 8:
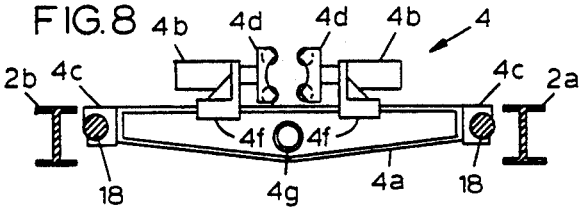
FIG. 8 is a view, somewhat enlarged, taken along line 8—8 of FIG. 3.

In FIG. 8, showing follower assembly 4 of FIG. 3, follower rollers 4*d*, mounted on rods of cylinders 4*b*, are adjustable for different drill string diameters and to clear the rollers for axial movement along drill string elements not rotating. The cylinders are carried by brackets 4*f* on cross frame 4*a* which is carried by slippers, or rail followers, 4*c* on tracks 18. Hole 4*g* admits the rod of cylinder 13 and, if necessary, can be fitted with a bushing to laterally support the rod when extended.

Figure 9:
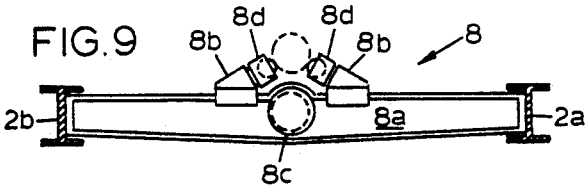
FIG. 9 is a view, somewhat enlarged, taken along line 9—9 of FIG. 3.

FIG. 9, showing stationary stabilizer roller assembly 8 of FIG. 3, is secured directly between the webs of beams 2*a* and 2*b* by cross beam 8*a*. Commercially available omni-directional spherical rollers 8*d* are secured by brackets 8*b* to beam 8*a*. Bore 8*c* accepts cylinder 13 and can be used to support the rather long cylinder.

Figure 10:
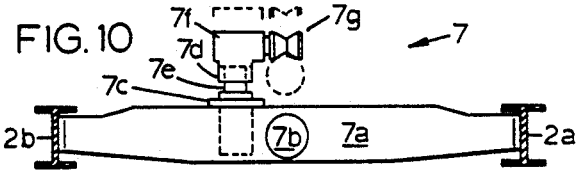
FIG. 10 is a view, somewhat enlarged, taken along line 10—10 of FIG. 3.

FIG. 10 shows stabbing roller assembly 7 of FIG. 3. Crossbeam 7*a*, preferably a box beam, is attached directly to the webs of beams 2*a* and 2*b*, has bore 7*b* to accept cylinder 13, and supports cylinder 7*c* with a vertical centerline to provide vertical adjustment for roller 7*g*. Roller 7*g* is powered by a hydraulic motor 7*f* which is mounted on cylinder rod 7*e* by way of a fraction-turn motor 7*d* which can pivot the roller about the centerline of cylinder 7*c* to clear the operational centerline as shown in FIG. 3. The cylinder 7*c* is commercially available with the rod and cylinder rotationally splined together to enable motor 7d to determine the azimuthal position of the roller 7g.

FIG. 5 will now be addressed. This is a pipe lifting cradle to move pipe sections vertically in and out of the operational centerline. Cradle beam 15a is lowered out of the way as shown until needed. To lift pipe DS1 from the centerline cylinder 15d is extended to pivot the cradle about pin 15d which is attached by brackets 15b to the web of beam 2a. Bracket 15c supports the cylinder for pivoting about pin 15e. With the cradle lifted as shown pipe DS2 can be rolled laterally, the top of the cradle beams serving as trundle rails, to receiving racks not shown.

Figure 11:
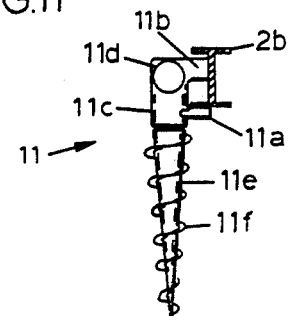
FIG. 11 is a side elevation, somewhat enlarged, of one powered ground screw assembly taken along line 11—11 of FIG. 3.

FIG. 11 shows powered ground screws 11 of FIG. 3. Gear box housing 11c has projections 11a and 11b which fasten to the base frame side beams, 1b shown, to support screw 11e with a vertical center line. Hydraulic motor 11d rotates the screw which augers into the earth due to the action of spiral fins 11f. The shape of the screw, which is removable from the gear box, is defined in view of the formation into which it is to anchor. The screw taper is more slender and the fins shorter for rock as compared to soil screws. In both cases, a starter hole is usually dug. There are six such anchor assemblies and they are individually powered to be run into the earth keeping the base frame level as anchoring proceeds.

Figure 12:
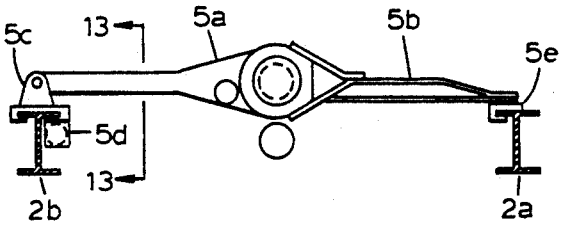
FIG. 12 is a side elevation, somewhat enlarged, of a power tong arrangement taken along line 12—12 of FIG. 3.
Figure 13:
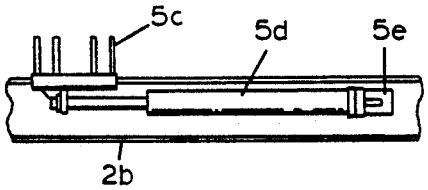
FIG. 13 is a view taken along line 13—13 of FIG. 12.

FIG. 12 shows the tong assembly 5 of FIG. 3. There are two tong sets 5 and 9 in FIG. 3. In this view only one tong is visible. On each tong set only the one tong, toward the other set, need be powered but both usually are powered. These are commercially available power tongs normally made for use on vertical rigs and some adaptation is provided for horizontal use. Tong 5a has torque and support extension 5b attached to ride on slipper 5e on beam 2a. The conventional torque arm is supported on slipper 5c which has a bracket 5d to attach to the rod of cylinder 5d. Cylinder 5d, shown in FIG. 13 with tongs removed, is supported by bracket 5e on beam 2b. The cylinder moves and positions the tong set to work tool joints on the operational centerline and moves the tongs clear of pipe sections to be moved laterally to and away from the operational centerline. Cylinder 13 is outlined just below the tong.

Figure 14:
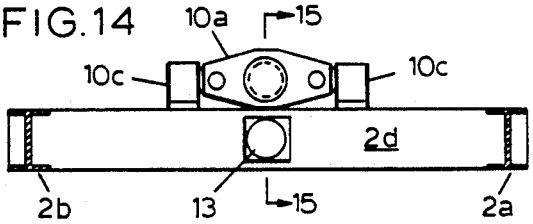
FIG. 14 is a view, somewhat enlarged, taken along line 14—14 of FIG. 3.
Figure 15:
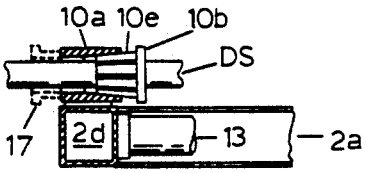
FIG. 15 is a partially sectioned view taken along line 15—15 of FIG. 14.
Figure 16:
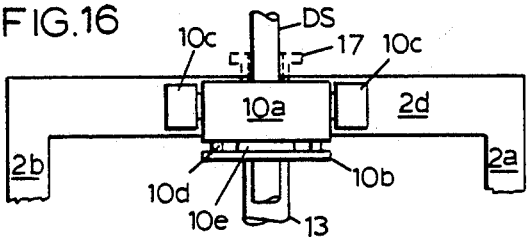
FIG. 16 is a top view of the arrangement of FIG. 14.

FIGS. 14, 15 and 16 show the powered slips 10 of FIG. 3 mounted on box beam 2d forming the front end of the top frame. The slip housing 10a is preferably trunnion mounted on trunnions 10c secured to beam 2d. The slips 10e are conventional slips secured to thrust plate 10b which, in turn, is secured to cylinder rods 10d which protrude from hydraulic cylinder bores (not shown) in the housing 10a to move the collet-type slips axially relative to the operational centerline. Housing 10a has the tapered bore, standard on vertical rigs, to cause the slips to grip or release the drill string DS when moved axially in the bore. Casing adapter 17, if used, attaches surface casing to the rig by way of the slip housing. Cylinder 13 is shown with its base attached to the box beam 2d.

Figure 17:
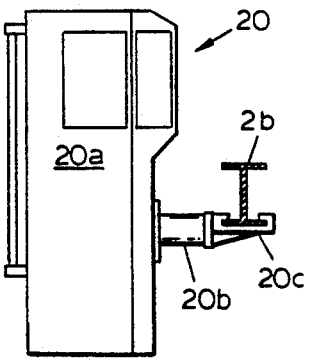
FIG. 17 is a side elevation of on of the three operator cabs provided for the overall apparatus of the invention.
Figure 18:
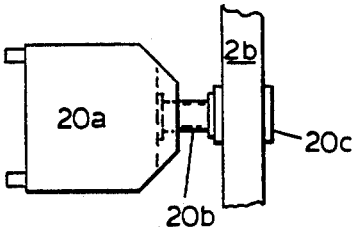
FIG. 18 is a top elevation of the cab of FIG. 17.

FIGS. 17 and 18 show the operator cabs, or stations, 20 shown on FIG. 3. There are three such stations, two attached to beam 2b as shown and one is on the opposite side attached to beam 2a. Slipper 20c is movable along beam 2b but is not mobile in that it is clamped solid when satisfactorily positioned for the job at hand. Slipper 20c supports pipe 20b which is bearingly secured to the cab 20a. Cab 20a is ballasted at the base so that it will remain vertical when the top frame is tilted but it is normally clamped against rotation when occupied to prevent pendulum action.

From the foregoing, it will be seen that this invention is one well adapted to attain all of the ends and objects hereinabove set forth, together with other advantages which are obvious and which are inherent to the rig.

It will be understood that certain features and sub-combinations are of utility and may be employed without reference to other features and sub-combinations. This is contemplated by and is within the scope of the claims.

As many possible embodiments may be made of the rig of this invention without departing from the scope thereof, it is to be understood that all matter herein set forth or shown in the accompanying drawings is to be interpreted as illustrative O and not in a limiting sense.

The invention having been described, we claim:

1. A receiving rig for handling the outcropping end of a drill string in earth surface to surface horizontal well bore operations, the rig comprising:

a) a base frame with means for anchoring to the earth, having a front end, a back end, side beams, and a general longitudinal center line;

b) a top frame for pipe handling comprising a front end, a back end, generally parallel side beams, parallel carrier rails extending the general length of said side beams, a frontal cross beam, and an operational center line above said side beams, hingedly attached to said base frame for tilting about a line generally transverse to a vertical plane containing said operational center line;

c) powered tilt means arranged to separate said base frame and said top frame at their back ends to align said operational center line with the drill string outcropping from the well bore;

d) swivel means mounted on said rails for longitudinal movement thereon, having an arbor, with a fluid conducting bore, extending forwardly therefrom bearingly supported for rotation about said operational center line and adapted for fluid tight attachment to a drill string extending forwardly along said operational center line, said swivel having plumbing to transport drilling fluid between said arbor bore and fluid handling plumbing from a remote fluid processing system;

e) at least one hydraulic thrust cylinder attached to said top frame and said swivel to move said swivel longitudinally along said rails;

f) at least two pipe tongs, with at least one tong powered, situated to apply break out and make up torque to tool joints when said tool joints are situated on said operational center line, said tongs arranged to be carried by said side beams of said top frame for limited longitudinal movement thereon;

g) at least one stabilizing pipe guide, carried by said rails for longitudinal movement thereon, situated to laterally stabilize pipe attached to said arbor and extending along said operational center line;

h) pipe clamp means situated near the front of said top frame, attached thereto, to axially secure drill string extending along said operational center line;

i) at least one operator station attached to said rig with manual controls accessible to an operator in said station for controlling power available from a remote power source to control power to, at least, said tilt means, said hydraulic cylinder, said tongs, and said pipe clamping means.

2. The rig of claim 1 wherein said means to anchor to the earth comprises a plurality of powered ground screws attached to said base frame with said screws extending vertically downward therefrom to rotate and screw into the earth.

3. The rig of claim 1 wherein said power tilt means comprises a tilt frame hingedly attached to said base frame for rotation about a line generally transverse to said base frame center line, with at least one hydraulic cylinder attached to said base frame and said tilting frame to rotate said tilting frame, and means to engage and tilt said top frame during rotation.

4. The rig of claim 1 wherein said rails comprise, at least in part, flanges on beams comprising said side beams of said top frame.

5. The rig of claim 1 wherein said rails comprise, at least in part, rails attached to and extending parallel to said side beams on said top frame.

6. The rig of claim 1 wherein said swivel is carried by a crosshead transversely extending between and carried by said rails for longitudinal movement thereon.

7. The rig of claim 6 wherein said hydraulic thrust cylinder extends parallel to said operational center line between said top frame side beams, attached to said frontal cross beam and to said crosshead, arranged to move said crosshead longitudinally along said rails when changing length.

8. The rig of claim 6 wherein there are two said pipe guides each carried by independent transverse beams distributed longitudinally along said rails for longitudinal movement thereon, with distance limiting means to establish a maximum preselected distance between said crosshead and the nearest said guide and a maximum preselected distance between said two guides.

9. The rig of claim 8 wherein said limiting means comprises at least one flexible element connecting said guide nearest to said crosshead and at least one flexible element connecting said two guides.

10. The rig of claim 1 wherein there are two sets of two pipe tongs each, each set of said two axially spaced apart arranged to manipulate one tool joint on said operational center line, said two sets distributed along said operational center line to manipulate tool joints on opposite ends of a pipe joint situated on said operational center line, each said tong set movable along said side beams of said top frame a preselected amount.

11. The rig of claim 1 wherein a powered pipe lifting cradle, attached to said top frame, is vertically movable between an idle position below said operational centerline and an elevated position to lift pipe from said operational center line and to provide trundle rails to permit pipe to be rolled laterally to and over one of said side beams of said top frame.

12. The rig of claim 1 wherein said pipe clamp means comprises cooperating tapered bore and tapered slips disposed peripherally about said operational center line to releasably grip pipe extending therethrough, said slips movable axially relative to said bore by at least one fluid powered cylinder.

13. The rig of claim 1 wherein a powered pipe stabbing roller is provided comprising a powered roller shaped to engage the outer surface of pipe situated on said operational center line and move said pipe in either axial direction, means to adjust the position of said roller to compensate for various pipe diameters, and means to move said roller clear of said pipe when not needed to move pipe.

14. A receiving rig for handling the outcropping end of a drill string in earth surface to surface horizontal well bore operations, the rig comprising:

a) a generally rectangular base frame having front and back ends, two generally parallel side beams and a longitudinal center line;

b) a top frame for pipe handling comprising a front end, a back end, generally parallel side beams, parallel carrier rails extending the general length of said side beams, a frontal cross beam, and an operational center line above said side beams, hingedly attached to said base frame for tilting about a line generally transverse to a vertical plane containing said operational center line;

c) tilt means attached to both said frames arranged to lift said back end of said top frame to rotate it about a line generally transverse to said axis to align said operational center line with the outcropping drill string;

d) swivel means, mounted on a crosshead extending transversely to and carried by said rails for longitudinal movement thereon, having an arbor with a fluid conducting bore extending forwardly therefrom bearingly supported for rotation about said operational center line and adapted for fluid tight attachment to a drill string extending forwardly along said operational center line, said swivel having plumbing to transport drilling fluid between said arbor bore and fluid handling plumbing from a remote fluid processing system;

e) at least one hydraulic cylinder attached to said top frame and said crosshead to move said swivel longitudinally along said rails;

f) at least two pipe tongs, with at least one tong powered, situated to apply break out and make up torque to tool joints when said tool joints are situated on said operational center line, said tongs arranged to be carried by at least one rail slipper for limited longitudinal movement along said side beam rails with at least one hydraulic cylinder attached between said top frame and said slipper to power said movement;

g) at least one stabilizing pipe guide, carried by at least one cross beam extending transversely between and carried by at least two rail slippers for longitudinal movement along said rails on said top frame with at least two pipe contact rollers, situated for lateral position adjustment to accept various pipe sizes, arranged to laterally stabilize pipe attached to said arbor and extending along said operational center line;

h) pipe clamp means situated near the front of said top frame, attached thereto, to axially secure drill string extending along said operational center line, said clamp comprising a body with a tapered bore disposed about said operational center line with an axially movable peripherally distributed array of tapered slip elements arranged to grip a pipe extending therethrough when forced axially into said tapered bore, with fluid power actuated closing means to move said slips axially to grip and release pipe;

i) a plurality of powered ground screws distributed along each side of and attached to said base frame with said screws extending vertically downward therefrom to rotate and screw into the earth;

j) at least one operator station attached to said rig with manual controls accessible to an operator in said station for controlling power available from a remote power source to control power to, at least, said tilt means, each of said hydraulic cylinders, said tongs, said pipe clamping means, and said power ground screws.

15. The rig of claim 14 wherein said rails comprise, at least in part, flanges on beams comprising said side beams of said top frame.

16. The rig of claim 14 wherein said rails comprise, at least in part, rails attached to and extending parallel to said side beams on said top frame.

17. The rig of claim 14 wherein there are two said pipe guides carried by transverse beams, independently carried by said rails for longitudinal movement, thereon with distance limiting means to establish a maximum preselected distance between said crosshead and the nearest said guide and a maximum preselected distance between said two guides.

18. The rig of claim 17 wherein said limiting means comprises at least one flexible element connecting said nearest guide to said crosshead and at least one flexible element connecting said two guides.

19. The rig of claim 14 wherein a powered pipe lifting cradle, attached to said top frame, is vertically movable between an idle position below said operational centerline and an elevated position to lift pipe from said operational center line and to provide trundle rails to permit pipe to be rolled laterally to and over one of said side beams of said top frame.

20. The rig of claim 14 wherein a powered pipe stabbing roller is provided comprising a powered roller shaped to engage the outer surface of pipe situated on said operational center line and move said pipe in either axial direction, means to adjust the position of said roller to compensate for various pipe diameters, and means to move said roller clear of said pipe when not needed to move pipe.

* * * * *